US005710584A

United States Patent [19]

Suzuki et al.

[11] Patent Number: 5,710,584

[45] Date of Patent: Jan. 20, 1998

[54] INK JET RECORDING HEAD UTILIZING A VIBRATION PLATE HAVING DIAPHRAGM PORTIONS AND THICK WALL PORTIONS

[75] Inventors: Kazunaga Suzuki; Minoru Usui; Noriaki Okazawa; Kazuhiko Miura; Takahiro Naka, all of Nagano, Japan

[73] Assignee: Seiko Epson Corporation, Tokyo, Japan

[21] Appl. No.: 349,992

[22] Filed: Nov. 29, 1994

[30] Foreign Application Priority Data

| | | | |
|---|---|---|---|
| Nov. 29, 1993 | [JP] | Japan | 5-298475 |
| Nov. 29, 1993 | [JP] | Japan | 5-298476 |
| Nov. 24, 1994 | [JP] | Japan | 6-314109 |

[51] Int. Cl.[6] ..... B41J 2/045

[52] U.S. Cl. ..... 347/70; 347/71

[58] Field of Search ..... 347/70–72, 94

[56] References Cited

U.S. PATENT DOCUMENTS

| | | | |
|---|---|---|---|
| 5,381,171 | 1/1995 | Hosono et al. | 347/72 |
| 5,424,769 | 6/1995 | Sakai et al. | 347/70 |
| 5,471,232 | 11/1995 | Hosono et al. | 347/70 |

FOREIGN PATENT DOCUMENTS

| | | | |
|---|---|---|---|
| 550030 | 7/1993 | European Pat. Off. | 347/71 |
| 563603A3 | 10/1993 | European Pat. Off. . | |

*Primary Examiner*—Benjamin R. Fuller
*Assistant Examiner*—Charlene Dickens
*Attorney, Agent, or Firm*—Sughrue, Mion, Zinn, Macpeak & Seas, PLLC

[57] ABSTRACT

An ink jet recording head formed by laminating and fixing: a flow path forming plate having through holes for defining pressure producing chambers, ink supply inlets, and a common ink chamber, a nozzle plate having nozzle openings communicating with the pressure producing chambers, and a vibration plate having diaphragm portions that are resiliently deformed in response to displacement of piezoelectric vibration elements one upon another with an adhesive so as to be watertight. The vibration plate has frame-like thick wall portions that extend as far as to the ink supply inlet side of the pressure producing chamber as well as to the inner side of the nozzle opening, and portions closer to a piezoelectric vibration element than to both ends of the pressure producing chamber are made to be supported by a base. As a result of this construction, a nonsupported region of the pressure producing chamber can be shortened, which in turn improves the rigidity of a substrate unit as a whole.

13 Claims, 9 Drawing Sheets

INK JET RECORDING HEAD UTILIZING A VIBRATION PLATE HAVING DIAPHRAGM PORTIONS AND THICK WALL PORTIONS

BACKGROUND OF THE INVENTION

1. Field of the Invention

The invention relates to an ink jet recording head that jets droplets of ink by contracting a vibration plate using piezoelectric vibration elements of vertical vibration mode, the vibration plate constituting pressure producing chambers that communicate with nozzle openings and a common ink chamber.

2. Related Art

An ink jet recording head using a piezoelectric vibration element of vertical vibration mode as a drive source, requiring only a small area of abutment of the piezoelectric vibration element against the vibration plate, can achieve an arrangement density of a pressure producing chamber as high as 90 dpi or more.

As shown in FIG. 14, such a recording head is fabricated into a single body by integrally fixing a substrate unit K to a base L. The substrate unit K is formed by laminating and fixing a flow path forming plate D, a nozzle plate F, and a vibration plate J with an adhesive so as to be watertight. The base L has a piezoelectric vibration element G, an ink supply pipe, and the like attached thereto. The flow path forming plate D has through holes defining a pressure producing chamber A, an ink supply inlet B, and a common ink chamber C; the nozzle plate F has a nozzle opening E communicating with the pressure producing chamber A; and the vibration plate J has a diaphragm portion H that is resiliently deformed in response to displacement of the piezoelectric vibration element G.

In the thus constructed ink jet recording head, the substrate unit must be fixed to the base so as to cause the diaphragm portion H to confront the base so that the diaphragm portion H can be abutted against the tip of the piezoelectric vibration element G. For this reason, the substrate unit is fixed to the base L so as to keep away from the pressure producing chamber A so that the base L does not come in contact with the diaphragm portion H.

To improve the pressure producing chamber arrangement density in an attempt to increase resolution, the length of the pressure producing chamber A must be increased in the axial direction since a predetermined capacity of the pressure producing chamber A must be ensured. However, the region confronting the pressure producing chamber A is a nonsupported region S1 that is not supported by the base L, and this region is long. As a result, when such region is given a predetermined displacement "a" by the piezoelectric vibration element G to jet a droplet of ink, the nonsupported region S1 of the substrate unit K becomes susceptible to flexion as shown by the broken lines in FIG. 14, thereby imposing the problem of impairing printing quality.

In addition, positional accuracy of the abutment of the tip of the piezoelectric vibration element G is an extremely important factor for such a high resolution. Therefore, to achieve the required accuracy, an island portion M, which is a thick wall portion formed almost in the middle of a region causing deformation of the pressure producing chamber, is formed, and the tip of the piezoelectric vibration element G is abutted against such island portion M, as disclosed in Japanese Unexamined Patent Publication No. 3-15555.

This construction allows the displacement of the piezoelectric vibration element G to be transmitted through the island portion M even if the position of abutment of the piezoelectric vibration element G is slightly shifted. Therefore, a predetermined displacement can be given to the diaphragm portion H.

However, for such an extremely high resolution as 180 dpi or more, inaccuracies in relative position between the island portion M and the pressure producing chamber A occur easily, causing the pressure producing chamber A to be deformed inconsistently, thereby giving rise to the problem of impaired printing quality.

Further, to reduce the pitch of the pressure producing chamber A, the partition wall defining the pressure producing chamber A becomes thin, which in turn reduces rigidity. As a result, one pressure producing chamber is deformed by contraction and expansion of a piezoelectric vibration element that drives another pressure producing chamber adjacent to such one pressure producing chamber, causing a so-called satellite. Moreover, the degree of deformation of the pressure producing chamber by the expansion of the piezoelectric vibration element is reduced, thereby imposing the problem of dropping ink jetting efficiency.

SUMMARY OF THE INVENTION

The invention has been made in consideration of the aforementioned problems and an object of the invention is, therefore, to provide an ink jet recording head in which the nonsupported region of the pressure producing chamber is made as short as possible so as to increase the rigidity of the substrate unit.

Another object of the invention is to provide a novel ink jet recording head capable of reducing the effect of fabrication inaccuracies upon printing quality to the smallest possible degree.

To achieve the above objects, the invention is applied to an ink jet recording head formed by fixing a substrate unit to a base, the substrate unit being formed by laminating and fixing a flow path forming plate, a nozzle plate, and a vibration plate with an adhesive so as to be watertight, the flow path forming plate having through holes defining pressure producing chambers, ink supply inlets, and a common ink chamber, the nozzle plate having nozzle openings communicating with the pressure producing chambers, and the vibration plate having diaphragm portions, each diaphragm portion being resiliently deformed in response to displacement of a piezoelectric vibration element. In such ink jet recording head, the vibration plate has a frame-like thick wall portion formed close to a side of the ink supply inlet of the pressure producing chamber and to a side of the nozzle opening, the thick wall portion being thicker than the diaphragm portion and extended so as to be island-like toward the piezoelectric vibration element, and a region confronting the frame-like thick wall portion is made to serve as a region for bonding the substrate unit to the base.

The frame-like thick wall portion extending toward the piezoelectric vibration element is supported by the base. As a result of this construction, the nonsupported region of the pressure producing chamber can be made as short as possible, which in turn allows the base to receive force applied by the piezoelectric vibration element and thereby increases the rigidity of the substrate unit.

BRIEF DESCRIPTION OF THE DRAWINGS

FIG. 13 (B) is a diagram schematically showing overflow of an adhesive; and

DETAILED DESCRIPTION OF THE PREFERRED EMBODIMENTS

Figure 1:
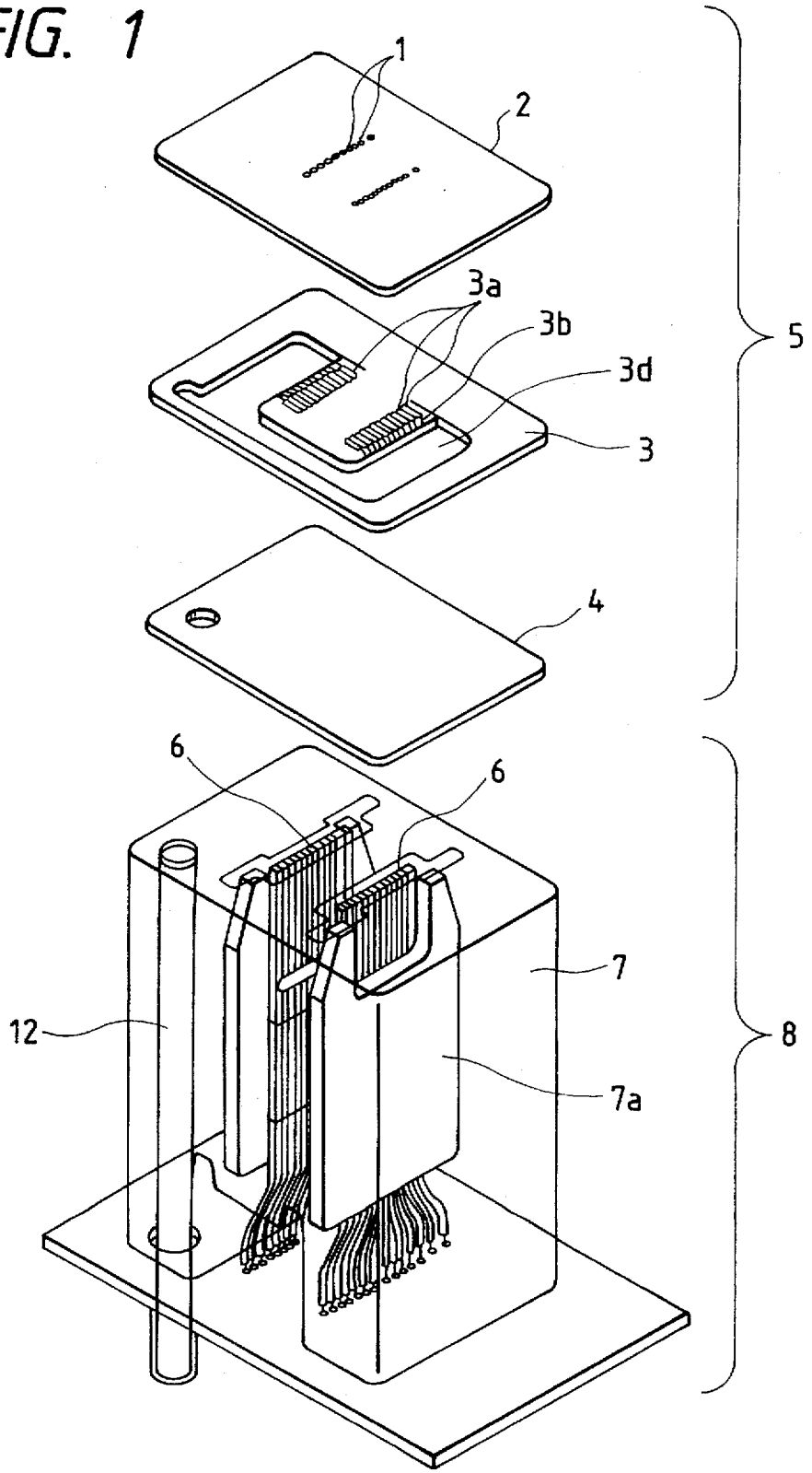
FIG. 1 is a perspective view showing an embodiment of an ink jet recording head of the invention in unfabricated form.

Details of the invention will now be described with reference to the embodiments shown in the drawings.

FIG. 1 shows the general aspect of a recording head of the invention. In FIG. 1 reference numeral 2 denotes a nozzle plate having nozzle openings 1 formed therein; 3, a flow path forming plate having through holes 3*a* defining pressure producing chambers 9, through holes or grooves 3*b* defining ink supply inlets 10, and a through hole 3*d* defining a common ink chamber formed therein; and 4, a vibration plate that is resiliently deformed while abutted against the tips of piezoelectric vibration elements 6. A substrate unit 5 is formed by fixing the nozzle plate 2 and the vibration plate 4 to both surfaces of the flow path forming plate 3 so as to be watertight.

Reference numeral 7 denotes a base into which the piezoelectric vibration elements 6 are inserted so that the piezoelectric vibration elements can vibrate therein. The ink jet recording head is fabricated into a single body by fixing the piezoelectric vibration elements 6 and the substrate unit 5 with the vibration plate 4 abutted against the tips of the piezoelectric vibration elements 6 exposed from openings of the base. It should be noted that reference numeral 12 in FIG. 1 denotes an ink supply pipe for supplying ink from a not shown ink tank to the substrate unit 5, reference numeral 7*a* denotes a mount for the elements 6, and 8 denotes the overall base unit.

Figure 2:
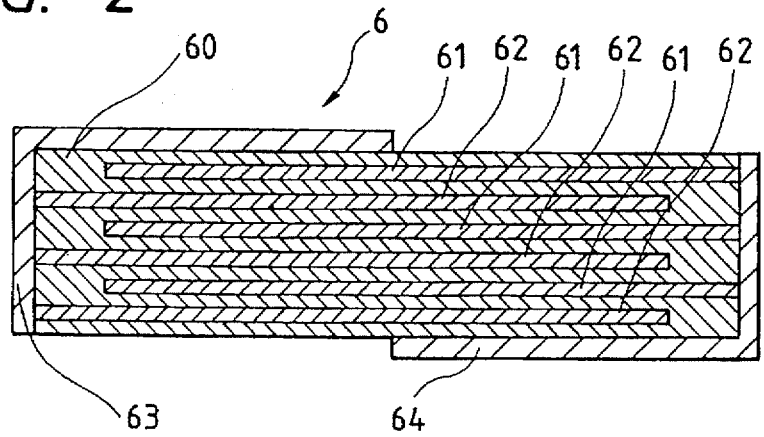
FIG. 2 is a sectional view showing an embodiment of a piezoelectric vibration element used for the head of FIG. 1.

FIG. 2 shows an embodiment of the piezoelectric vibration element 6. A plurality of layers, each being formed by interposing a piezoelectric material layer 60 between electrode layers 61, 62, are laminated one upon another to form a laminated member. Ends of the electrode layers 61 and ends of the electrode layers 62 are exposed to ends of the laminated member so as to be connected to a segment electrode 63 and a common electrode 64, respectively, so that the piezoelectric vibration element 6 can expand and contract in directions parallel with the electrode layers 61, 62.

Figure 3:
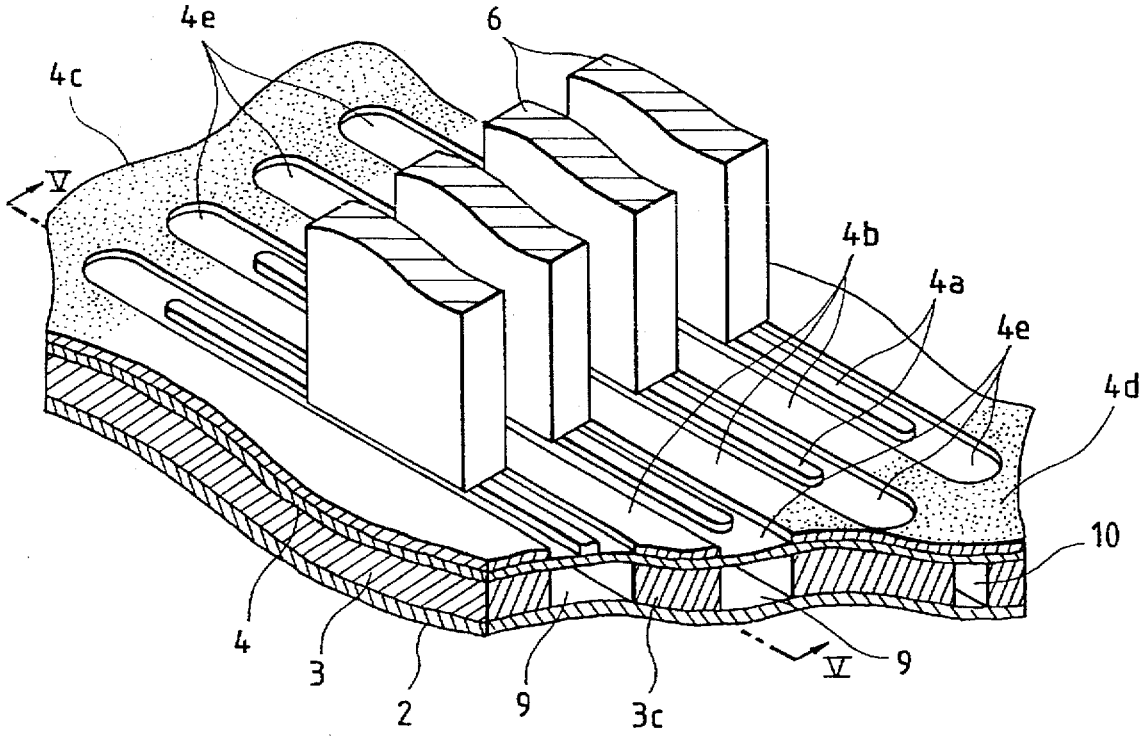
FIG. 3 is a partially sectional perspective view showing a region at which a substrate unit and piezoelectric vibration elements of the head of FIG. 1 are abutted against one another in enlarged form.
Figure 4:
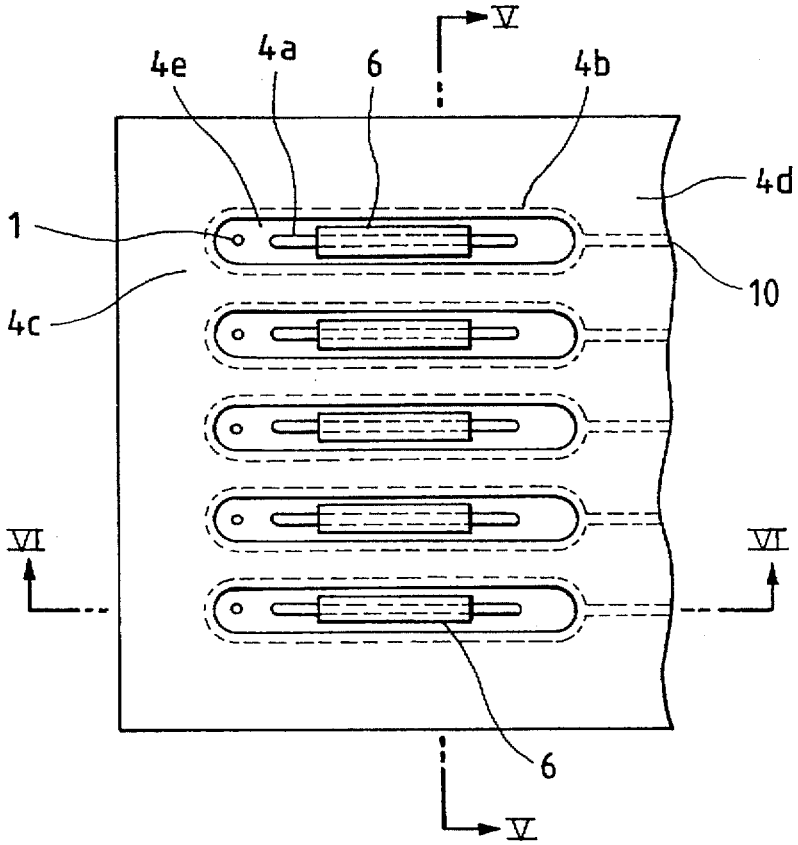
FIG. 4 is a diagram showing the position of a flow path forming plate relative to a vibration plate of the head of FIG. 1.

FIG. 3 is a diagram showing how the substrate unit 5 and the piezoelectric vibration elements 6 are mounted. The nozzle plate 2 and the vibration plate 4 bracket the flow path forming plate 3 and are fixed to both surfaces of the flow path forming plate 3 with an adhesive so as to be watertight, so that the pressure producing chambers 9 are formed so as to extend along the arrays of the nozzle openings 1.

Figure 5:
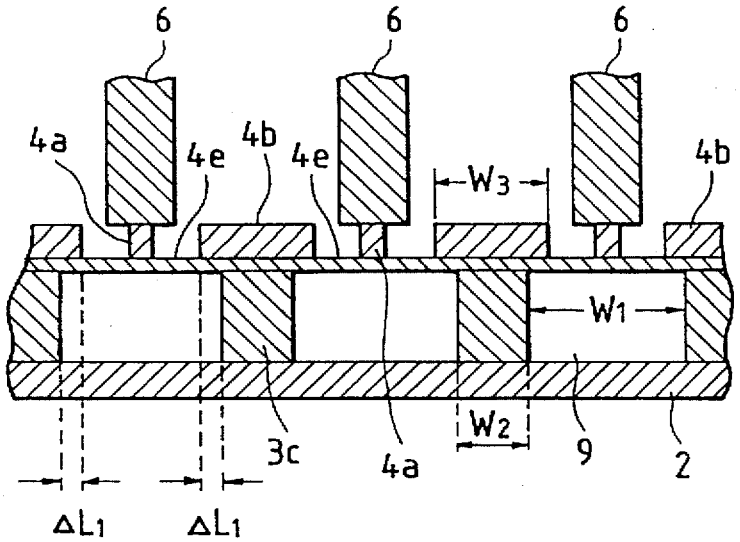
FIG. 5 is a sectional view taken along a line V—V of FIG. 4.

On the other hand, in the vibration plate 4 an island portion 4*a* is formed so as to be positioned almost in the middle of a region confronting the corresponding pressure producing chamber 9, and a first thick wall portion 4*b*, and second and third thick wall portions 4*c*, 4*d* are also formed. The island portion is abutted against the tip of the piezoelectric vibration element 6. The first thick wall portion 4*b* is formed so as to confront a partition wall 3*c* partitioning the adjacent pressure producing chambers 9 and either coincide with the boundary of the pressure producing chamber 9 or slightly overhang the pressure producing chamber 9 as shown in FIG. 5. The second and third thick wall portions 4*c*, 4*d* are formed so as to slightly overhang both ends of the pressure producing chamber 9. A region, which is a thin wall portion surrounded by the first, second, and third thick wall portions 4*b*, 4*c*, 4*d*, is defined as a diaphragm portion 4*e*. The diaphragm portion 4*e* is deformed by the piezoelectric vibration element 6.

Figure 6:
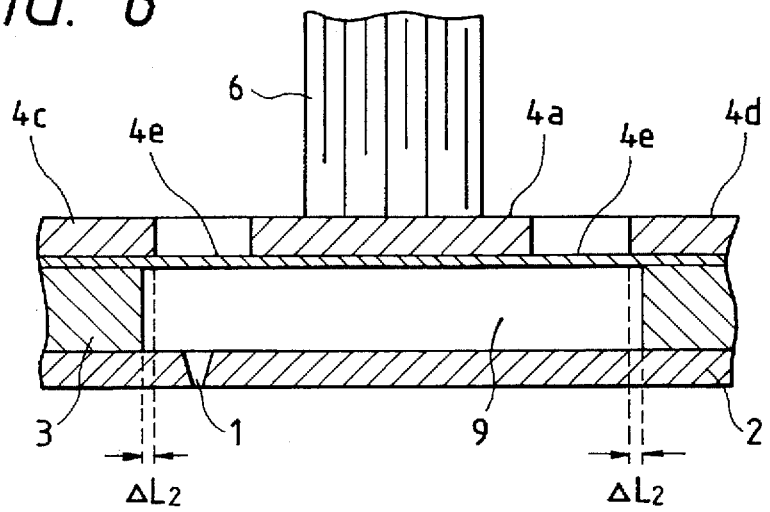
FIG. 6 is a sectional view taken along a line VI—VI of FIG. 4.

If the diaphragm portion 4*e* is formed to a size smaller than the opening of the pressure producing chamber 9, so that the thick wall portions 4*b*, 4*c*, 4*d* of the vibration plate 4 overhang the pressure producing chamber 9, then the first thick wall portion 4*b* overhangs the pressure producing chamber 9 by $\Delta L1$ from the wall 3*c* defining the pressure producing chambers (FIG. 5), and the second and third thick wall portions 4*c*, 4*d* also overhang the pressure producing chamber by $\Delta L2$ in the vicinities of both ends of the pressure producing chamber (FIG. 6).

Let us take a specific example, in which the width W1 of the pressure producing chamber 9 is set to 200 μm; the width W2 of the partition wall 3*c* is set to 80 μm; and the width W3 of the first thick wall portion 4*b* is set to 140 μm. Then, an overhanging length $\Delta L1$ of 30 μm can be provided in the case where the flow path forming plate 3 and the vibration plate 4 are bonded to each other with the center line of the pressure producing chamber 9 aligned with that of the island portion 4*a*.

Figure 7:
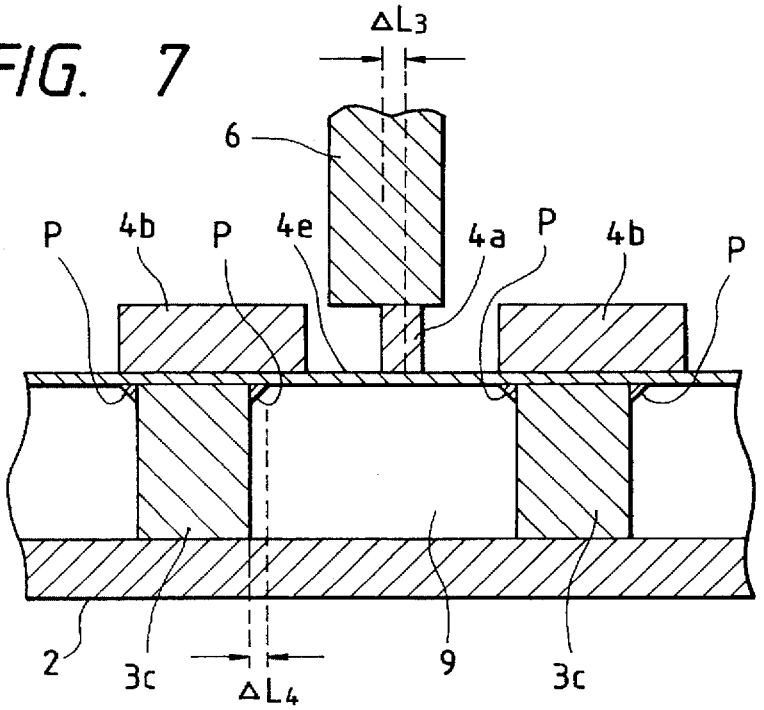
FIG. 7 is a sectional view showing misalignment between the vibration plate and the flow path forming plate as well as overflow of an adhesive that bonds the vibration plate to the flow path forming plate when the head of FIG. 1 is being fabricated.

As a result, when the diaphragm portion 4*e* is positioned so as to confront the pressure producing chamber 9 with a positioning error $\Delta L3$ between the flow path forming plate 3 and the vibration plate 4 being equal to, e.g., 20 μm as shown in FIG. 7, an adhesive P overflow region $\Delta L4$ of as large as 10 μm can be provided. As a result, even if the adhesive P overflows from the partition wall 3*c*, such overflown adhesive P is absorbed by the first, second, and third thick wall portions 4*b*, 4*c*, 4*d* to thereby block the adhesive P from further overflowing to the diaphragm portion 4*e*, which in turn allows the diaphragm portion 4*e* to maintain a consistent resilient characteristic.

Figure 13A:
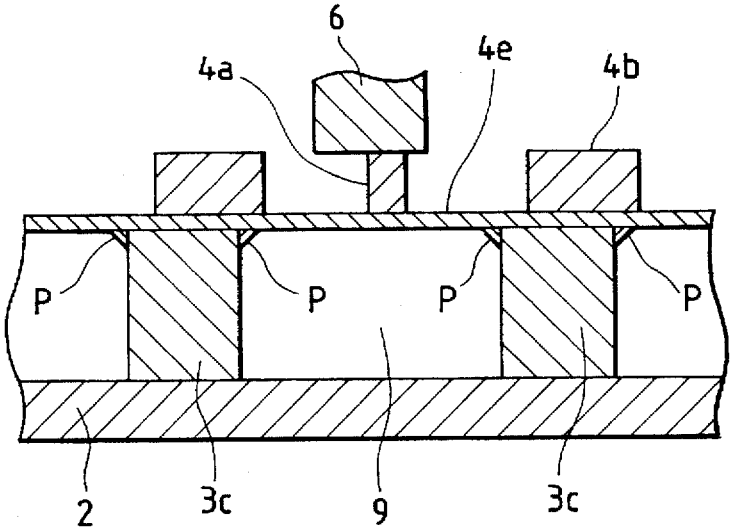
FIG. 13 (A) is a sectional view showing an exemplary comparative ink jet recording head.
Figure 13B:
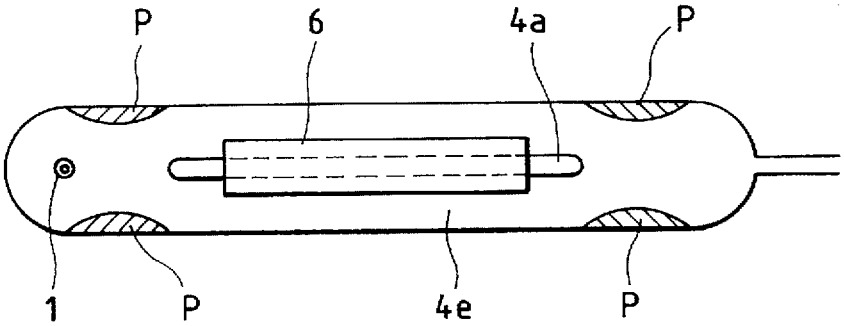

That is, if the vibration plate 4 and the flow path forming plate 3 are misaligned with the thick wall portion 4*b* formed so as to coincide with the width of the partition wall 3*c* of the pressure producing chamber 9, the adhesive P overflows into the diaphragm portion 4*e* (as shown in FIGS. 13(A) and 13(B)), making the vibration characteristic of the diaphragm portion 4*e* erratic.

In general, when the width W3 of the first thick wall portion 4*b* confronting the partition wall 3*c* is increased by about 5 to 50% with respect to the width W2 of the partition wall 3*c* defining the adjacent pressure producing chambers 9, fabrication errors can be absorbed, and the ink jetting performance can therefore be maintained consistent.

On the other hand, the diaphragm portion 4*e* is defined by the frame-like second and third thick wall portions 4*c*, 4*d*, whose thicknesses are substantially the same as that of the island portion 4*a*, as well as by the first thick wall portion 4*b*, which is integrally formed with the second and third thick wall portions and extends in parallel with the partition wall 3*c* of the pressure producing chamber 9. As a result, the partition wall 3*c* defining the pressure producing chamber 9 is reinforced not only by the nozzle plate 2 but also by the first thick wall portion 4*b* of the vibration plate 4, which in turn increases the rigidity of the substrate unit 5 as a whole with respect to the displacement of the piezoelectric vibration element 6. Hence, the flexion of the substrate unit 5 at the time the ink is jetted can be minimized, thereby preventing crosstalks.

Figure 8:
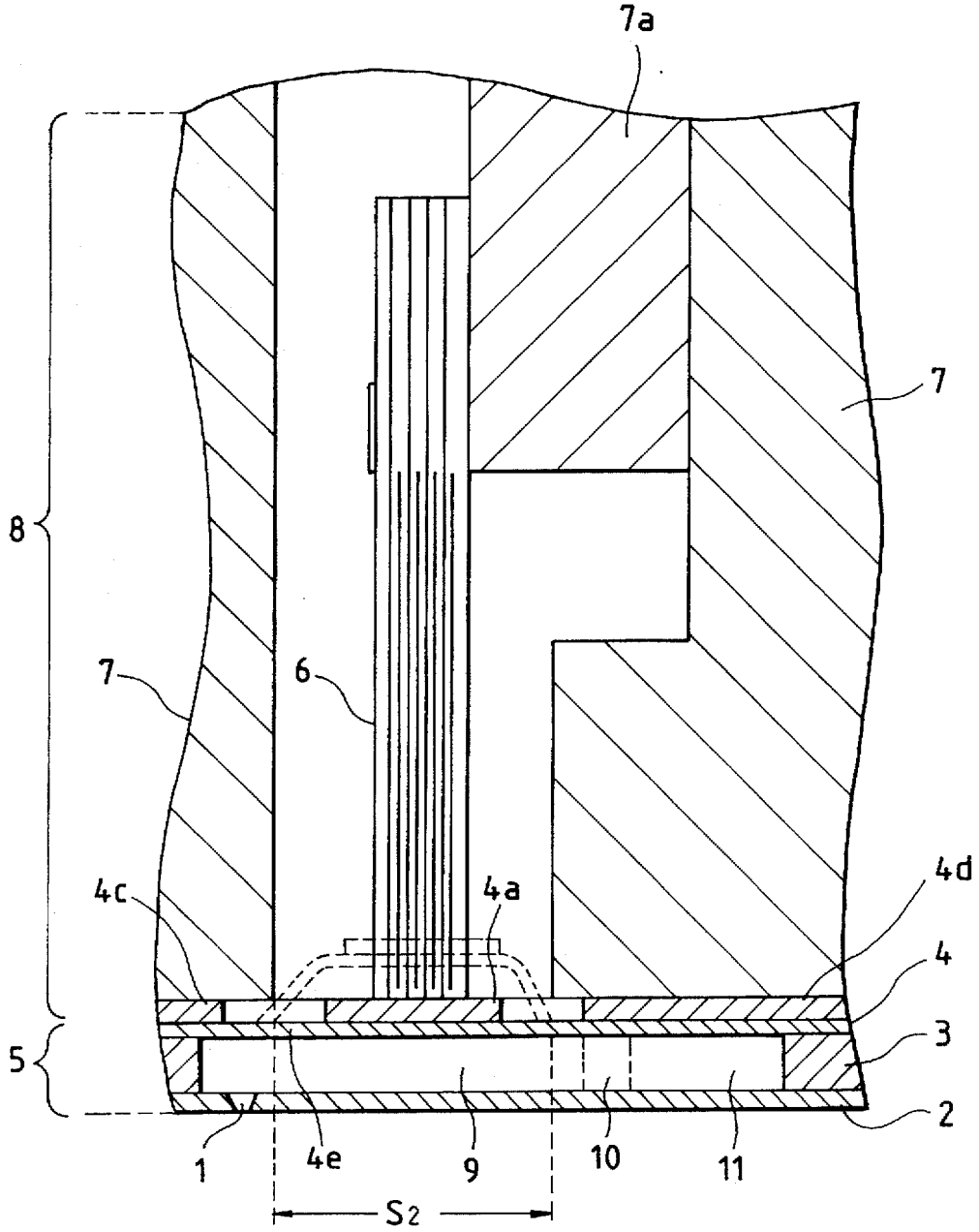
FIG. 8 is a diagram showing a structure of a section taken along an axial line of a pressure producing chamber.
Figure 14:
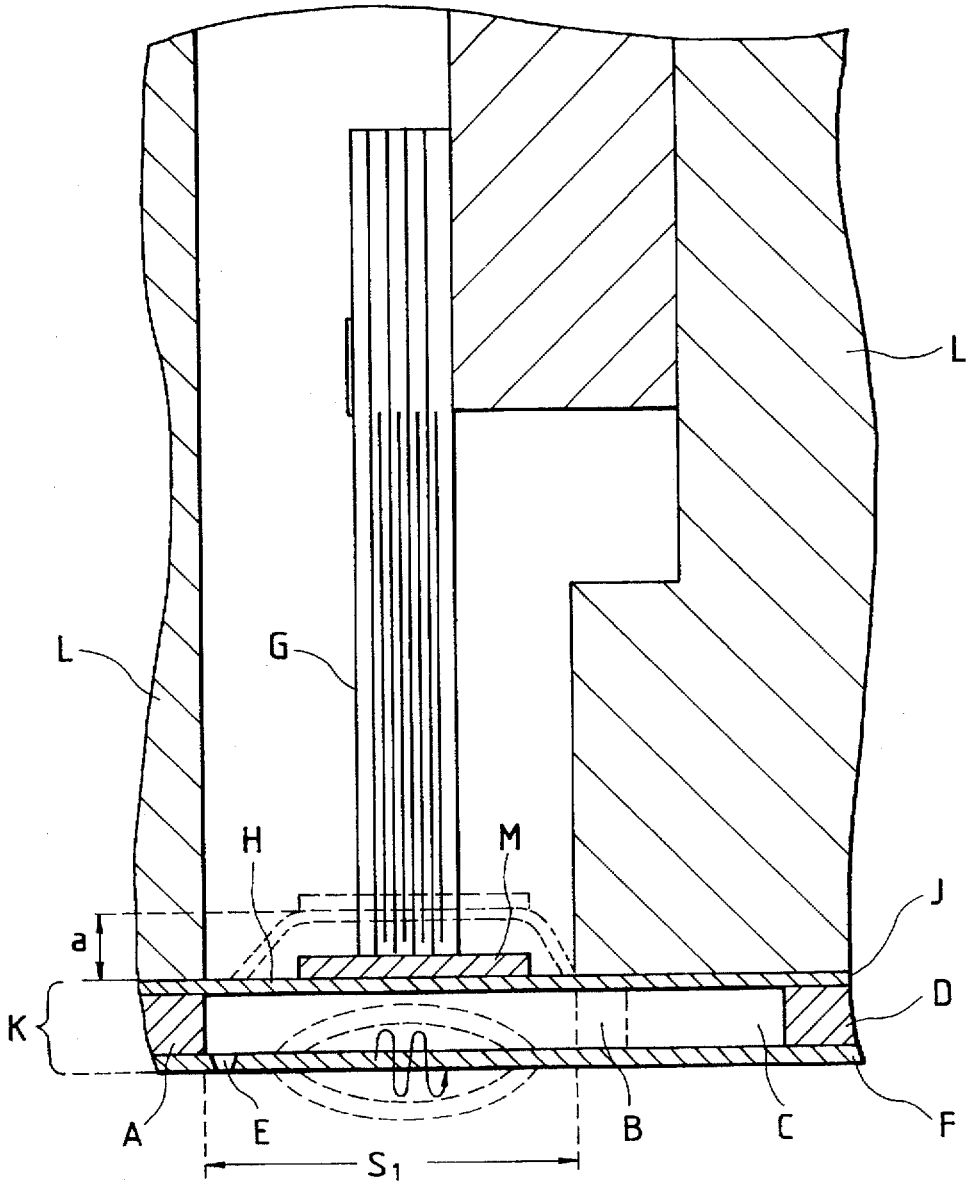
FIG. 14 is a diagram showing an exemplary comparative ink jet recording head.

Further, as shown in FIG. 8, the second and third thick wall portions 4*c*, 4*d* formed on both ends of the pressure producing chamber 9 extend toward the piezoelectric vibration element 6 so as to go along with the partition wall 3*c* of the pressure producing chamber 9, and the extended regions (the dotted regions in FIG. 3) are supported by the base 7 while fixed to the base 7 with the adhesive. Therefore, a nonsupported region S2 can be rendered shorter than the nonsupported region S1 (FIG. 14) in the conventional example, making flexion of the substrate unit 5 due to displacement of the piezoelectric vibration element 6 less.

The vibration plate 4 may be formed by electroforming nickel, chromium, or the like (for forming the island portion 4*a* and the thick wall portions 4*b*, 4*c*, 4*d*) on a high molecular film such as polyimide, polysulfone, polycarbonate, polyetherimide, polyethylene, polyalamide, or polyester; or by laminating the high molecular film on a metal film such as nickel, chromium, stainless steel, gold, silver, copper, or titanium by casting or the like and etching the metal film so as to match the profiles of the island portion 4*a* and the thick wall portions 4*b*, 4*c*, 4*d*; or by using a metal film such as silicon, nickel, chromium, stainless steel, or titanium and partially etching a region for forming the diaphragm portion 4*e*.

A 40 μm-thick stainless steel film and a 3 μm-thick polyimide film were laminated by bonding, and the stainless steel film was etched to prepare the vibration plate 4 in this particular embodiment.

Figure 9:
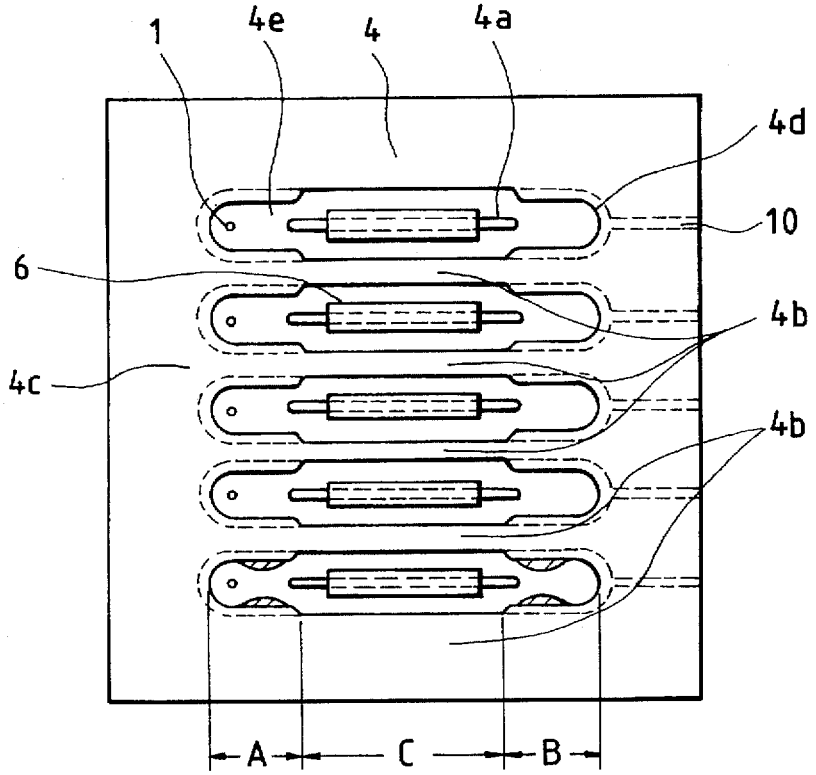
FIG. 9 is a diagram showing a second embodiment of the invention in the form of an upper surface structure of the vibration plate.

FIG. 9 shows a second embodiment of the invention. The second embodiment is characterized as causing only portions close to both ends of the pressure producing chamber 9 (regions A, B in FIG. 9) of the first thick wall portion formed on the vibration plate 4 to overhang the pressure producing chamber, and causing the width of a region (a region C in FIG. 9) of the first thick wall portion confronting the island portion 4*a* to coincide with the width of the partition wall 3*c* defining the pressure producing chamber 9.

According to the second embodiment, the area of the diaphragm portion 4*e* can be increased only if accuracy in aligning the vibration plate 4 with the flow path forming plate 3 is improved. In addition, the region fixed by the base 7 can be made as large as possible, i.e., the nonsupported region S2 can be shortened to reduce flexion of the substrate unit 5.

Figure 10:
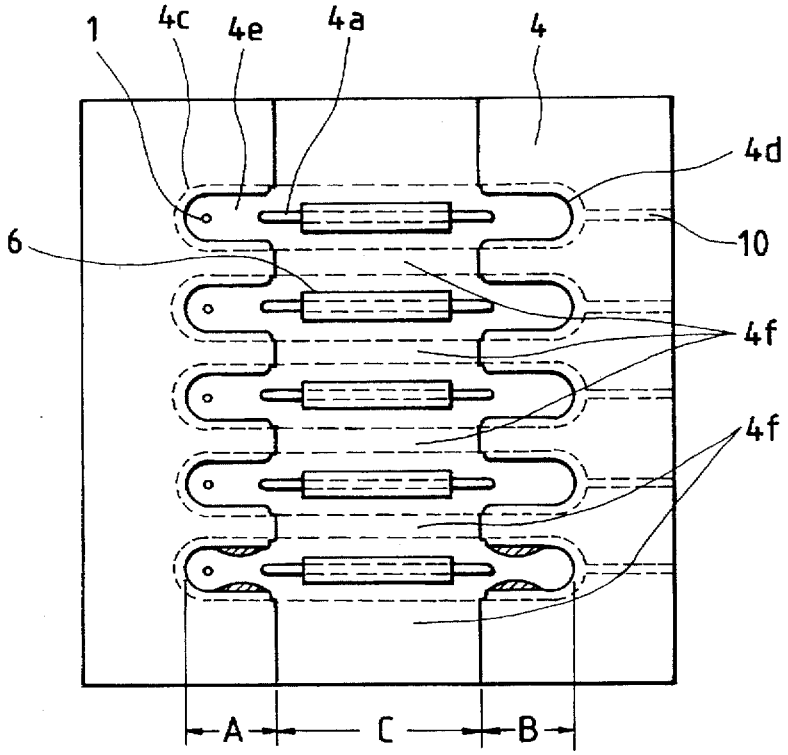
FIG. 10 is a diagram showing a third embodiment of the invention in the form of an upper surface structure of the vibration plate.

FIG. 10 shows a third embodiment of the invention. The third embodiment is characterized as extending those portions of the second and third thick wall portions 4*c*, 4*d* that are close to both ends of the pressure producing chamber 9 to form peninsulas extending out to both ends of the island portion 4*a* (regions A, B in FIG. 10), and replacing the first thick wall portion 4*b* with a thin wall portion 4*f*. According to the third embodiment, the region supported by the base 7 is made as long as possible to reduce flexion of the substrate unit 5. If the adhesive for bonding the substrate unit 5 to the base 7 is applied by transferring, the region to which the adhesive is applied can be limited within the semiisland-like thick wall portions, thereby preventing the adhesive for fixing the base 7 from overflowing as far as to the diaphragm portion 4*e*.

In this embodiment, a bonding process between the base 7 and the thick wall portions 4*c* and 4*d* is performed at a region defined between an inner side of the pressure producing chamber 9 and outer sides of both ends of the island portion 4*a* in order to prevent the base 7 and the island portion 4*a* from contacting each other by a vibration of the vibration plate 4 when the ink expelling operation is performed.

Figure 11:
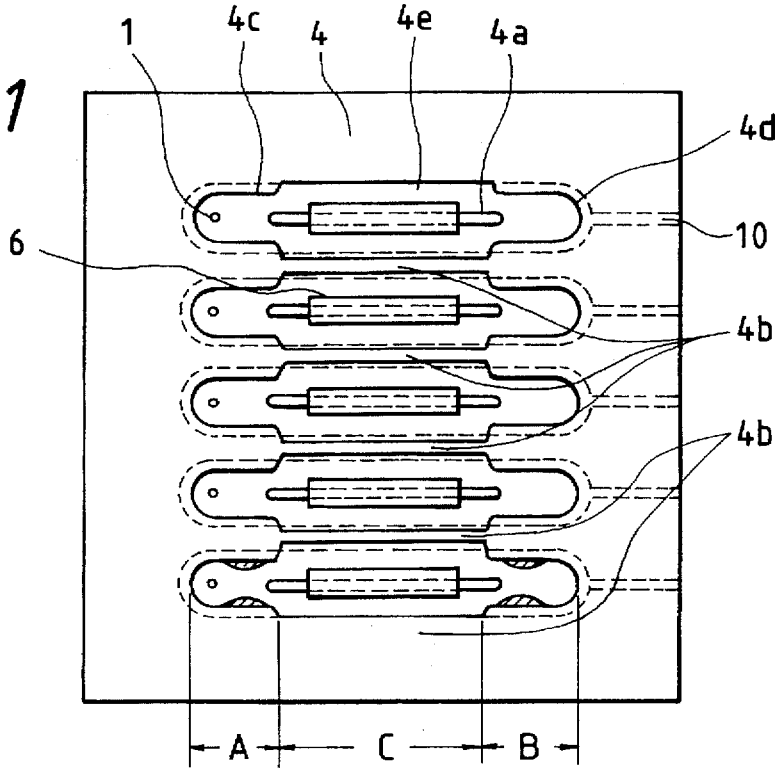
FIG. 11 is a diagram showing a fourth embodiment of the invention in the form of an upper surface structure of the vibration plate.

FIG. 11 shows a fourth embodiment of the invention. The fourth embodiment is characterized as forming the first thick wall portion 4*b* in a region (a region C in FIG. 11) confronting the island portion so as to be continuous to the aforementioned semi-island-like second and third thick wall portions 4*c*, 4*d* so that the width of the first thick wall portion 4*b* is slightly smaller than that of the partition wall 3*c*.

According to the fourth embodiment, not only is the rigidity of the substrate unit as a whole improved and the area of the diaphragm portion 4*e* made as large as possible, but also the region supported by the base 7 can be increased to prevent flexion of the substrate unit 5.

While the aforementioned embodiments have been described as using piezoelectric vibration elements having a vertical vibration mode as their drive source, piezoelectric vibration elements of flexion vibration mode may also be used.

Figure 12:
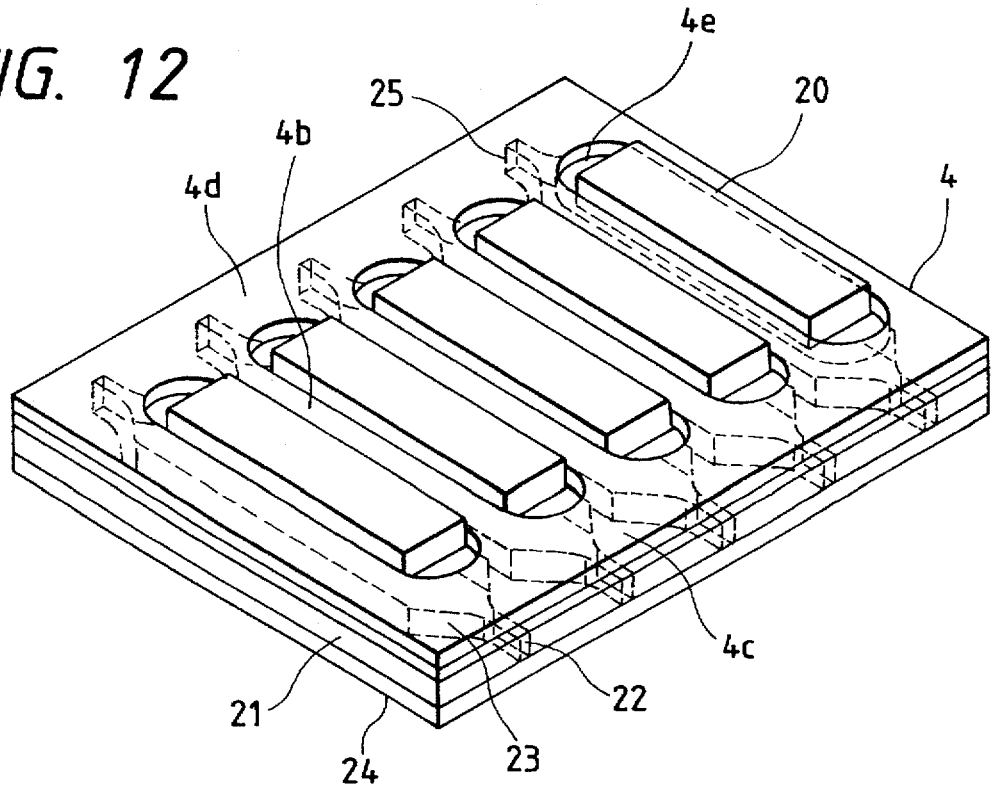
FIG. 12 is a diagram showing an embodiment in which piezoelectric vibration elements of flexion vibration mode are used.

That is, as shown in FIG. 12, a piezoelectric vibration element 20 of flexion vibration mode is bonded onto the surface of the diaphragm portion 4*e* defined by the thick wall portions 4*b*, 4*c*, 4*d* so as not to come in contact with the thick wall portions 4*b*, 4*c*, 4*d*. The island portion 4*a* is not formed. As a result of this construction, the diaphragm portion 4*e* is contracted to thereby contract a pressure producing chamber 23 formed of a flow path forming plate 21, a second cover plate 24, and a vibration plate 4, which in turn causes ink to be jetted out of a nozzle opening 22 communicating with the pressure producing chamber 23. In this embodiment also, the propagation of vibrations to the adjacent pressure producing chambers 23 can be prevented by the thick wall portions 4*b*, 4*c*, 4*d*. It should be noted that reference numeral 25 denotes an ink supply inlet.

As described in the foregoing, the ink jet recording head of the invention is formed by fixing a substrate unit to a base, the substrate unit being formed by laminating and fixing a flow path forming plate, a nozzle plate, and a vibration plate with an adhesive so as to be watertight, the flow path forming plate having through holes defining pressure producing chambers, ink supply inlets, and a common ink chamber, the nozzle plate having nozzle openings communicating with the pressure producing chambers, the vibration plate having diaphragm portions, each diaphragm portion being resiliently deformed in response to displacement of a piezoelectric vibration element, and in such ink jet recording head, the vibration plate has frame-like thick wall portions formed close to a side of the ink supply inlet of the pressure producing chamber and to a side of the nozzle opening, the thick wall portions being thicker than the diaphragm portion and extended so as to be island-like toward the piezoelectric vibration element, and a region confronting the frame-like thick wall portions is made to serve as a region for bonding the substrate unit to the base. As a result of this construction, the nonsupported region of the pressure producing chamber can be shortened without disturbing the displacement of the diaphragm portion, which in turn reduces flexion of the substrate unit attributable to displacement of the piezoelectric vibration element.

What is claimed is:

1. An ink jet recording head comprising:

a substrate unit formed by laminating and fixing a flow path forming plate, a nozzle plate, and a vibration plate, said flow path forming plate having at least one pressure producing chamber extending between at least two opposing chamber sides, at least one ink supply inlet, and a common ink chamber; said nozzle plate having at least one nozzle opening communicating with the pressure producing chamber; said vibration plate having at least one diaphragm portion, the diaphragm portion being resiliently deformable in response to a displacement force applied to the diaphragm portion; and said substrate unit being fixed to a base housing a piezoelectric vibration element, wherein said vibration plate has a frame-like thick wall portion formed close to the chamber sides of the pressure producing chamber and has a further thick wall portion that is formed over the diaphragm portion; the frame-like thick wall portion and the further thick wall portion are thicker than the diaphragm portion; the frame-like thick wall portion is elongated toward the piezoelectric vibration element at least at a surface of the frame-like thick wall portion facing the chamber sides and attached to the diaphragm portion so that the surface overhangs the chamber sides, to form elongated portions; the further thick wall portion is interposed between the diaphragm portion and the piezoelectric vibration element; and a region of the frame-like thick wall portion, including the elongated portions, serves as a region for bonding said substrate unit to the base.

2. An ink jet recording head according to claim 1, wherein an island-like thick wall portion is formed at a region confronting the piezoelectric vibration element, and the island-like thick wall portion corresponds in thickness to the frame-like thick wall portion.

3. An ink jet recording head according to claim 1, wherein the frame-like thick wall portion extends so as to confront a partition wall defining the pressure producing chamber.

4. An ink jet recording head according to claim 1, wherein said base houses plural piezoelectric vibration elements forming an array, and the thick wall portion is discontinuous at regions interposed between the piezoelectric vibration elements.

5. An ink jet recording head according to claim 1, wherein a width of the thick wall portion narrows to a width narrower than a width of a partition wall bounding the pressure producing chamber at some locations where the thick wall portion confronts the partition wall.

6. An ink jet recording head according to claim 1, wherein the frame-like thick wall portion is formed close to a side of the ink supply inlet of the pressure producing chamber and to a side of the nozzle opening.

7. An ink jet recording head comprising:

a substrate unit formed by laminating and fixing a flow path forming plate, a nozzle plate, and a vibration plate, said flow path forming plate having at least one pressure producing chamber bounded by partition walls, at least one ink supply inlet, and a common ink chamber; said nozzle plate having at least one nozzle opening communicating with the pressure producing chamber; said vibration plate having at least one diaphragm portion, the diaphragm portion being resiliently deformable in response to a displacement force applied to the diaphragm portion, wherein said vibration plate has a frame-like thick wall portion confronting the partition walls bounding the pressure producing chamber, the frame-like thick wall portion is thicker than the diaphragm portion, and the frame-like thick wall portion overhangs the pressure producing chamber at least at a surface of the frame-like thick wall portion facing the partition walls and attached to the diaphragm portion.

8. An ink jet recording head according to claim 7, wherein a width of the frame-like thick wall portion at regions confronting the partition walls bounding the pressure producing chamber is set to a value 5 to 50% larger than a width of the partition walls bounding the pressure producing chamber.

9. An ink jet recording head according to claim 7, wherein the pressure producing chamber has longitudinal ends, and a region of the frame-like thick wall portion at the longitudinal ends of the pressure producing chamber serves as a region for bonding said substrate unit to a base.

10. An ink jet recording head according to claim 9, wherein the base is bonded to said substrate unit with a predetermined pitch defined between the base and the diaphragm portion.

11. An ink jet recording head according to claim 7, wherein the frame-like thick wall portion is formed close to at least a side of the ink supply inlet of the pressure producing chamber and to a side of the nozzle opening.

12. An ink jet recording head according to claim 1, wherein a width of the thick wall portion is wider than a width of a partition wall bounding the pressure producing chamber.

13. An ink jet recording head according to claim 1, wherein the chamber is defined by chamber walls that include the chamber sides and that surround the chamber, and the thick wall portion overhangs the chamber walls at all locations where the thick wall portion confronts the chamber walls.

* * * * *